United States Patent [19]

Liverance et al.

[11] Patent Number: 4,926,301

[45] **Date of Patent: * May 15, 1990**

[54] HEADLAMP ASSEMBLY

[75] Inventors: Martin K. Liverance, Royal Oak, Mich.; David R. McMahan; Bartly A. Haydu, both of Anderson, Ind.

[73] Assignee: General Motors Corporation, Detroit, Mich.

[ * ] Notice: The portion of the term of this patent subsequent to May 24, 2005 has been disclaimed.

[21] Appl. No.: 408,870

[22] Filed: Sep. 18, 1989

Related U.S. Application Data

[63] Continuation of Ser. No. 276,608, Nov. 28, 1988, Pat. No. 4,882,660, which is a continuation of Ser. No. 185,109, Apr. 18, 1988, abandoned, which is a continuation of Ser. No. 930,741, Nov. 13, 1986, Pat. No. 4,747,029.

[51] Int. Cl.[5] ..... H01R 33/00

[52] U.S. Cl. ..... 362/226; 362/61; 313/113; 439/546; 439/616

[58] Field of Search ..... 362/266, 257, 296, 306, 362/341, 226, 457, 429, 310, 61; 439/546, 616; 313/113, 114, 115

[56] References Cited

U.S. PATENT DOCUMENTS

| | | | |
|---|---|---|---|
| 4,682,274 | 7/1987 | Freudenreich et al. | 362/61 |
| 4,747,029 | 5/1988 | Liverance et al. | 362/226 |
| 4,760,506 | 7/1988 | Mochizuki et al. | 362/226 |
| 4,794,500 | 12/1988 | Bradley | 362/226 |
| 4,882,660 | 11/1989 | Liverance et al. | 362/226 |

*Primary Examiner*—Ira S. Lazarus
*Assistant Examiner*—Richard R. Cole
*Attorney, Agent, or Firm*—Edward J. Biskup

[57] ABSTRACT

A vehicle headlamp in which the rear of the reflector has fastened thereto a retainer assembly that receives a replaceable light bulb and includes a shield for blocking stray light rays emanating from the light bulb.

3 Claims, 3 Drawing Sheets

HEADLAMP ASSEMBLY

This is a continuation of application Ser. No. 276,608 filed on Nov. 28, 1988 (now U.S. Pat. No. 4,882,660) which is a continuation of application Ser. No. 07/185,109 filed on Apr. 18, 1988 (now abandoned) which was a continuation of application Ser. No. 930,741 filed on Nov. 13, 1986 (now U.S. Pat. No. 4,747,029).

This invention concerns headlamps and more particularly relates to a vehicle headlamp having a retainer arrangement for maintaining a replaceable light bulb within an opening formed in the rear of a headlamp reflector.

More specifically, the vehicle headlamp according to the present invention includes a reflector, the rear portion of which has a circular opening. A retainer assembly is secured to the rear portion of the reflector for supporting a replaceable light bulb and serves to locate the light bulb in a predetermined position relative to the reflecting surface of the reflector. In the preferred form, the retainer assembly includes an inner disk member and an outer disk member fastened together so as to form a cavity for receiving the light bulb. The outer disk member is formed with a plurality of access slots and spring members for receiving the retainer members formed on the light bulb after which the latter is rotated so that the retainer members move into the cavity and assume a locked position relative to the retainer assembly. The inner disk member has a central opening surrounded by an axially extending skirt which supports a shield for blocking stray light rays emanating from the light bulb when the replaceable light bulb is located within the reflector.

The objects of the present invention are to provide a new and improved vehicle headlamp provided with a retainer assembly for a replaceable light bulb that is fastened to the rear of the reflector and is formed by a pair of disk members one of which has access slots for receiving the retainer members on the light bulb; to provide a new and improved vehicle headlamp in which the reflector carries a heat sink in the form of a retainer assembly that receives a replaceable light bulb and includes a shield attachable thereto for blocking stray light rays emanating from the light bulb; to provide a new and improved vehicle headlamp having a retainer assembly fastened to the rear of the reflector that includes a pair of disk members fastened together so as to provide a circular cavity for accommodating the retainer members formed on a replaceable light bulb and has locator tabs formed on the retainer assembly cooperating with bosses and locator pads on the reflector for properly locating the retainer assembly on the reflector; and to provide a new and improved vehicle headlamp which includes a retainer assembly that receives and supports a replaceable light bulb in a predetermined position relative to the reflecting surface of the reflector and also has connected thereto a cylindrical shield for blocking stray light rays emanating from the light bulb.

Other objects and advantages of the present invention will be apparent from the following detailed description when taken with the drawings in which FIG. 1 is a plan view showing a vehicle headlamp partially in section with the lens removed and made in accordance with the present invention;

Figure 1:
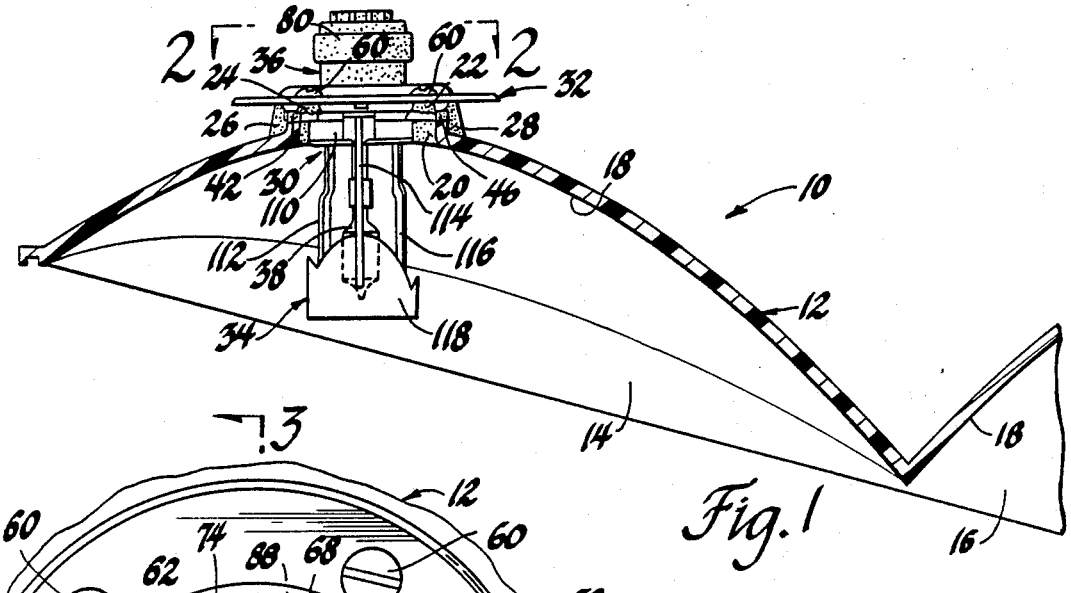
Figure 6:
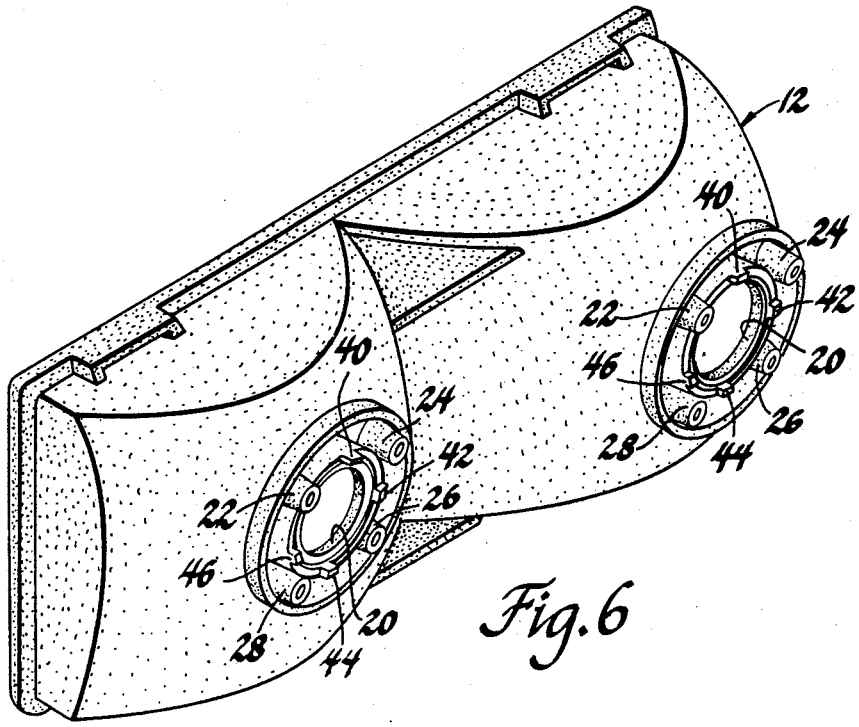
FIG. 6 is a perspective view showing the construction of the rear portion of the reflector shown in FIG. 1 with the retainer assembly removed therefrom.

Referring now to the drawings and more particularly FIG. 1 thereof, a vehicle headlamp 10 (with lens removed) made in accordance with the present invention is shown having a reflector 12 made of plastic and formed with a pair of side-by-side cavities 14 and 16 each of which has an aluminized parabolic reflecting surface 18. As seen in FIGS. 1 and 6, the rear of each cavity 14 and 16 of the reflector 12 is formed with a circular opening 20 surrounded by four circumferentially spaced and identical cylindrical bosses 22, 24, 26, and 28 to which is fastened a retainer assembly 30.

The retainer assembly 30 includes a retainer section 32 and a shield section 34, both of which are made from sheet metal. The retainer section 32 serves to support a replaceable light bulb assembly 36 and is fastened to the reflector 12 and located thereon so as to assure that the light bulb 38 is positioned in a predetermined position relative to the reflecting surface 18 of the associated cavity in the reflector 12. It will be noted that although both cavities of the reflector 12 may be provided with a retainer section identical to retainer section 32, the shield section 34 is only needed in the outboard cavity which accommodates a light bulb having filaments for both high beam and low beam projection. The shield section 34 serves to assure that when the low beam filament is energized, stray light rays are blocked and that a lighting pattern as prescribed by federal regulations is attained forwardly of the vehicle.

Figure 3:
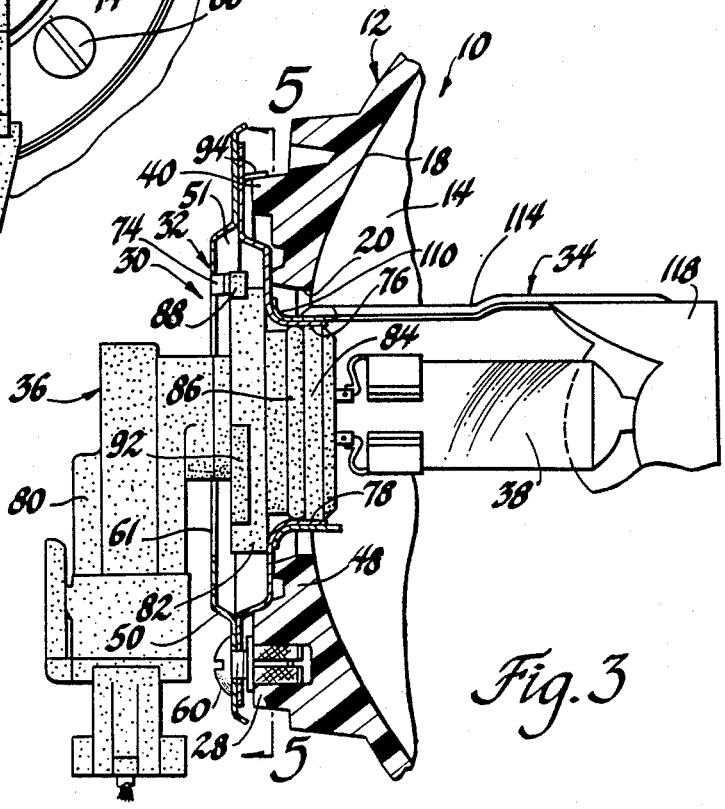
FIG. 3 is a side elevational view taken on line 3—3 of FIG. 2 showing the retainer assembly which includes a shield section for blocking stray light rays emanating from the light bulb.
Figure 5:
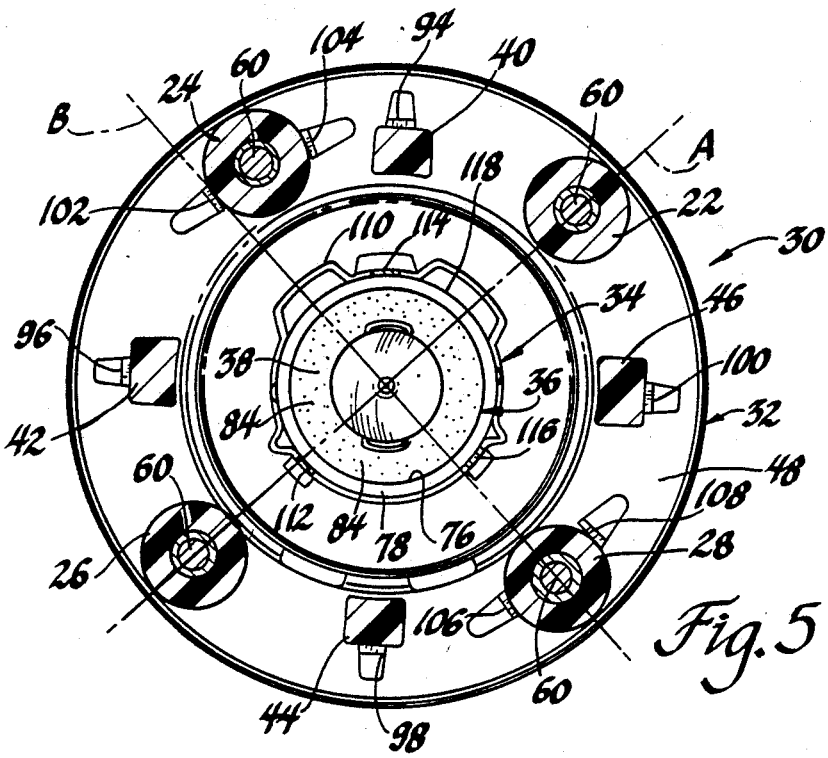
FIG. 5 is a view taken on a line 5—5 of FIG. 3 showing the construction of the inner disk member which forms a part of the retainer assembly.

As seen in FIGS. 3, 5, and 6, the circular opening 20 of each cavity 14 and 16 in the reflector 12 is also surrounded by four locator pads 40, 42, 44, and 46 which are integrally formed with the reflector 12. As will be hereinafter explained more fully, the outer peripheral surface of the locator pads 40, 42, 44, and 46 serve to properly locate the retainer section 32 along an X-axis and a Y-axis during the assembly of the retainer section 32 to the reflector 12.

Figure 2:
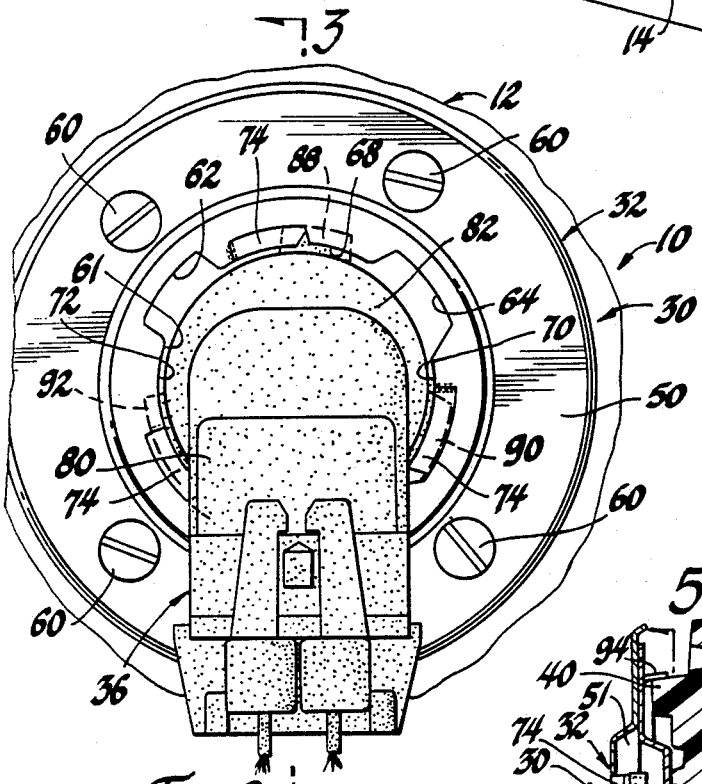
FIG. 2 is an enlarged elevational view taken on line 2—2 of FIG. 1 showing the rear of a retainer assembly for a replaceable light bulb that forms a part of the vehicle headlamp.
Figure 4:
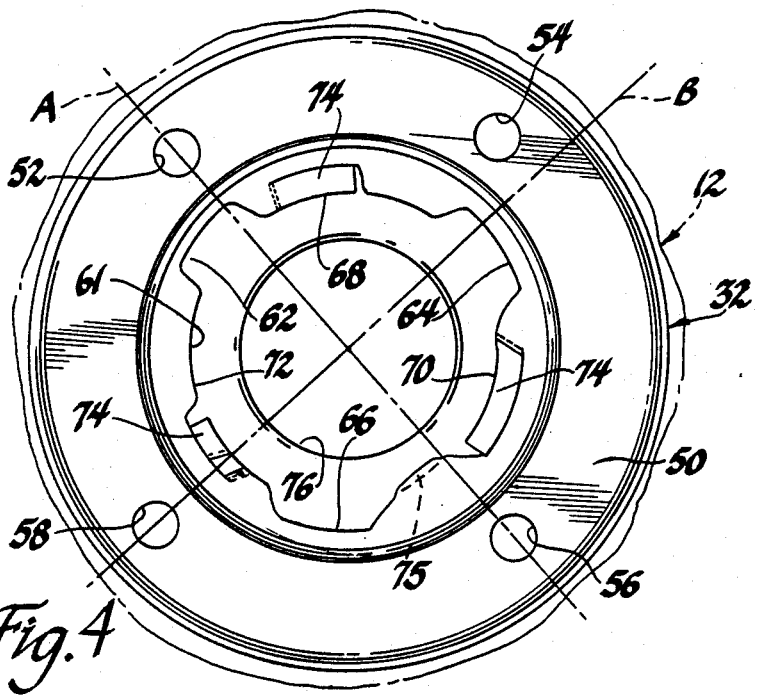
FIG. 4 is a view of the retainer assembly similar to the view in FIG. 2 with the replaceable light bulb removed.
Figure 7:
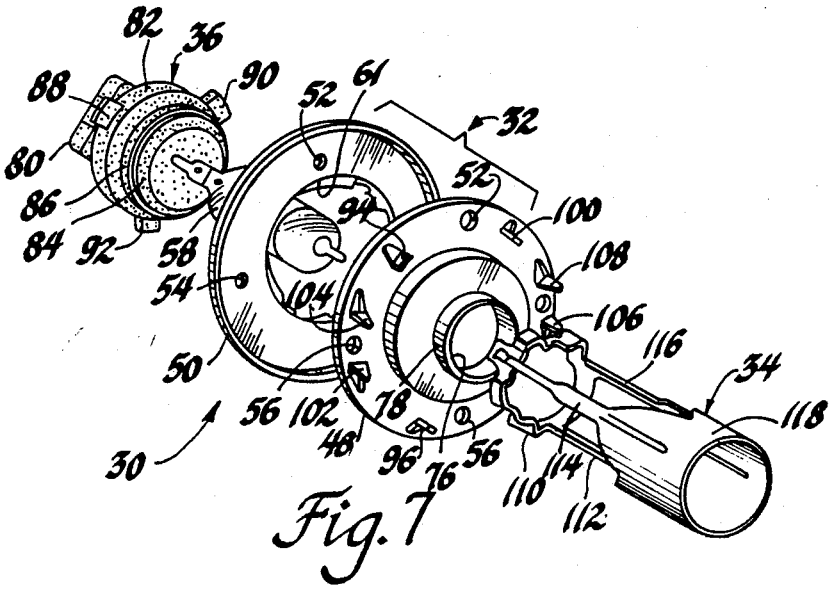
FIG. 7 is an exploded view showing the various parts of the retainer section and the attachable shield section which make up the retainer assembly.

Referring now to FIGS. 2, 3, and 7, the retainer section 32 includes an inner disk member 48 and an outer disk member 50, each of which is generally hat-shaped in cross-section. The disk members 48 and 50 are fastened together by spot welding or the like so as to form a unitary member having a ring-like cavity 51 for supporting the light bulb assembly 36. More specifically, the outer disk member 50 as well as the inner disk member 48, as seen in FIG. 4, have four identical circular registering openings 52, 54, 56 and 58 formed therein through which fastener means such as screws 60 (seen in FIGS. 2 and 3) serve to secure the retainer section 32 to the cylindrical bosses 22–28 formed on the reflector 12. In this regard, it will be noted that as seen in FIG. 5, the center of the bosses 22 and 26 are aligned along an axis A passing through the center of the retainer member 32. On the other hand, the center of the boss 24 is offset angularly relative to the axis B which passes through the center of the retainer section 32 and through the center of the boss 28. As should be apparent, the openings 52–58 formed in the retainer section 32 are similarly arranged so as to assure proper location of the retainer section 32 onto the reflector 12 during the assembly operation.

As seen in FIG. 4, the outer disk member 50 is formed with a central opening 61 surrounded by three radially extending access slots 62, 64 and 66 which connect with curved walls 68, 70 and 72, each of which includes a spring section 74 depressed towards the inner disk member 48. In addition, an inwardly projecting stop member 75 is formed on the wall 70. The inner disk member 48 is formed with a circular opening 76 which, as seen in FIG. 3, is defined by an axially extending cylindrical skirt portion 78.

The central opening 61 in the outer disk member 50 is adapted to receive the light bulb assembly 36 and, in this regard, it will be noted that as seen in FIGS. 1, 2, and 3, the light bulb assembly 36 includes a body portion 80 made of an insulating material such as plastic that receives the wedge-base type light bulb 38. The body portion 80 is integrally formed with a collar 82 having an outer diameter larger than the diameter of the opening 76 formed in the inner disk member 48 and smaller than the opening 61 defined by the curve walls 68–72 of the outer disk member 50. A neck portion 84 is integrally formed with the collar 82 and carries an 0-ring 86 which assures a snug sealed fit is realized between the inner wall of the opening 76 and the neck portion 84 when the light bulb assembly 36 is located in the retainer section 32 as seen in FIG. 3. It will also be noted that the collar 82 is integrally formed with three radially outwardly extending and circumferentially spaced retainer members 88, 90 and 92 which are adapted to be received by the access slots 62, 64 and 66, respectively, formed in the outer disk member 50 of the retainer section 32. In this regard, it will be noted that the access slots 64 and 66 are identical in size and configuration while the access slot 62 is smaller in size than the slots 64 and 66. Similarly, the retainer and members 90 and 92 have the general configuration and size of access slots 64 and 66 while retainer member 88 is designed to be received only by access slot 62. This retainer member and access slot design assures that the light bulb assembly 36 is properly located within the opening 61 in the retainer section 32 when manually inserted therein.

Thus, when the light bulb assembly 38 is inserted into the opening 61, the retainer members 88, 90 and 92 are aligned with and located within the access slots 62, 64, and 66 and afterwards the body portion 80 is rotated clockwise until retainer member 90 contacts the stop 75. As seen in FIG. 2, the light bulb assembly 38 will then assume the position shown in FIGS. 2 and 3 at which point the light bulb assembly 36 is prevented from further clockwise movement by the stop member 75 seen in FIG. 4. It will be understood that the spring sections or arms 74 adjacent each access slot serve to press the collar 82 into contact with the inner disk member as seen in FIG. 3 so that proper orientation of the light bulb assembly 36 along the longitudinal axis of the bulb 38 and relative to the reflecting surface 18 is attained.

Referring again to the inner disk member 48 and particularly FIGS. 3 and 5, it will be noted that the rim portion of the inner disk member 48 has four locator tabs 94, 96, 98 and 100 projecting outwardly therefrom and located on a circle concentric with the opening 76. The locator tabs 94, 96, 98 and 100 cooperate with the locator pads 40, 42, 44 and 46, respectively, for properly locating the retaining section 32 along the aforementioned X-axis and Y-axis. Also, two sets of locator tabs 102, 104 and 106, 108 are provided which cooperate with the bosses 24 and 28 formed on the reflector 12 for properly locating the retainer assembly 30 angularly relative to the opening 20 in the reflector 12. Inasmuch as the boss 24 is offset as explained hereinbefore, it should be apparent that the retainer section 32 cannot be located on the reflector 12 except in one position relative to the opening 20, that position being as seen in FIGS. 2 and 3.

As seen in FIGS. 1, 3, and 7, the shield section 34 is formed with a ring like mounting member 110 which mounts onto the skirt 78 and is connected by three axially extending arms 112, 114, and 116 to the shield portion 118. The shield portion 118 serves in the usual manner, namely to prevent light rays emanating directly from the low beam filament of the light bulb 38 to pass out of the reflector without being reflected by the parabolic reflecting surface 18. As heretofore alluded to, this assures that the proper pattern of light is projected forwardly of the vehicle when the low beam filament is energized.

Thus, from the above description, it should be apparent that when the retainer section 32 is fastened to the reflector 12, the locator pads 40–46 and the bosses 24 and 28 cooperate with the locator tabs 94–108 on the inner disk member 48 to assure that the skirt portion 78 is properly located in the opening 20 of the reflector 12. In addition, depending upon the size of the opening 20 of the reflector 12, the shield section 34 can be either preassembled onto the skirt portion 78 as shown in FIG. 3, and passed through the opening 20 or mounted on the skirt portion 78 after the retainer section 32 is fastened to the reflector 12 and before the lens is sealed to the reflector. In either case, inasmuch as the shield member 34 connects to the retainer member 32 directly, one is assured that the shield member 34 is properly located at all times relative to the light bulb 38. Also, because the retainer section 32 and shield section 34 are both made from a metallic material, they both serve as a heat sink for helping dissipate heat generated by the light bulb assembly 36.

Various changes in modifications can be made in this construction without departing from the spirit of the invention. Such changes and modifications are contemplated by the inventors and they do not wish to be limited except by the scope of the appended claims.

The embodiments of the invention in which an exclusive property or privilege is claimed are defined as follows:

1. In combination, a vehicle headlamp assembly including a reflector formed with a pair of side-by-side cavities each of which has a parabolic reflecting surface and a circular opening formed in each of said reflecting surfaces and adapted to receive the light bulb of a replaceable light bulb assembly from the rear of said reflector, locator means and boss means formed on said reflector for assuring proper positioning of said light bulb assembly in said circular opening along a longitudinal axis of the light bulb and an axis angled relative to said longitudinal axis, a retainer located at the rear of said reflector and having a first portion and a second portion cooperating with said boss means and said locator means for positioning said light bulb assembly in a predetermined position relative to said circular opening, said light bulb of said replaceable light bulb assembly being smaller in diameter than said circular opening and said replaceable light bulb assembly having a collar and three circumferentially spaced retainer members projecting radially outwardly therefrom, said retainer having three access slots formed therein for selectively receiving said three retainer members of said replaceble bulb assembly, said retainer defining a ring-like cavity with an axial dimension sufficient to accommodate said retainer members on said light bulb assembly, a stop in said cavity, said access slots upon receiving said retainer members of said light bulb assembly permitting said collar and said retainer members to move into said ring-like cavity from the rear thereof after which said light bulb assembly is rotatable into engagement with said stop to orient said light bulb assembly rotationally with respect to said reflector, and means formed as a part of said retainer extending into said ring-like cavity and continuously engaging and pressing said retainer members inwardly towards said opening when said light bulb assembly is rotated to orient said light bulb axially with respect to said reflector.

2. In combination, a vehicle headlamp assembly including a reflector formed with a pair of side-by-side cavities each of which has a parabolic reflecting surface and a circular opening formed in each of said reflecting surfaces and adapted to receive the light bulb of a replaceable light bulb assembly from the rear of said reflector, locator means and boss means formed integrally with said reflector and projecting outwardly therefrom for assuring proper positioning of said light bulb assembly in said circular opening along a longitudinal axis of the light bulb and an axis angled relative to said longitudinal axis, a retainer located at the rear of said reflector and having a first portion and a second portion cooperating with said boss means and said locator means for positioning said light bulb assembly in a predetermined position relative to said circular opening, said light bulb of said replaceable light bulb assembly being smaller in diameter than said circular opening and said replaceable light bulb assembly having a collar and three circumferentially spaced retainer members projecting radially outwardly therefrom, said retainer having three access slots formed therein for selectively receiving said three retainer members of said replacable bulb assembly, said retainer defining a ring-like cavity with an axial dimension sufficient to accommodate said retainer members on said light bulb assembly, a stop in said cavity, said access slots upon receiving said retainer members of said light bulb assembly permitting said collar and said retainer members to move into said ring-like cavity from the rear thereof after which said light bulb assembly is rotatable into engagement with said stop to orient said light bulb assembly rotationally with respect to said reflector, and means formed as a part of said retainer extending into said ring-like cavity and continuously engaging and pressing said retainer members inwardly towards said opening when said light bulb assembly is rotated to orient said light bulb axially with respect to said reflector.

3. In combination, a vehicle headlamp assembly including a reflector formed with a pair of side-by-side cavities each of which has a parabolic reflecting surface and a circular opening formed in each of said reflecting surfaces and adapted to receive the light bulb of a replaceable light bulb assembly from the rear of said reflector, locator means and boss means formed integrally with said reflector and projecting outwardly therefrom for assuring proper positioning of said light bulb assembly in said circular opening along a longitudinal axis of the light bulb and an axis angled relative to said longitudinal axis, a retainer located at the rear of said reflector and having a first portion and a second portion cooperating with said boss means and said locator means for positioning said light bulb assembly in a predetermined position relative to said circular opening, said light bulb of said replaceable light bulb assembly being smaller in diameter than said circular opening and said replaceable light bulb assembly having a collar and three circumferentially spaced retainer members projecting radially outwardly therefrom, said retainer having three access slots formed therein for selectively receiving said three retainer members of said replaceble bulb assembly, said retainer defining a ring-like cavity with an axial dimension sufficient to accommodate said retainer members on said light bulb assembly, a stop in said cavity, said access slots upon receiving said retainer members of said light bulb assembly permitting said collar and said retainer members to move into said ring-like cavity from the rear thereof after which said light bulb assembly is rotatable into engagement with said stop to orient said light bulb assembly rotationally with respect to said reflector, means formed as a part of said retainer extending into said ring-like cavity and continuously engaging and pressing said retainer members inwardly towards said opening when said light bulb assembly is rotated to orient said light bulb axially with respect to said reflector, and a shield located in one of said side-by-side cavities for blocking stray light rays emanating from said light bulb.

* * * * *